US005766543A

United States Patent [19]

Dainton

[11] Patent Number: 5,766,543

[45] Date of Patent: Jun. 16, 1998

[54] FLOW CONTROL DEVICE

[75] Inventor: Albert Edward Dainton, Medina, Ohio

[73] Assignee: Foseco International Limited, Swindon, England

[21] Appl. No.: 793,463

[22] PCT Filed: Aug. 15, 1995

[86] PCT No.: PCT/GB95/01930

§ 371 Date: Feb. 26, 1997

§ 102(e) Date: Feb. 26, 1997

[87] PCT Pub. No.: WO96/07496

PCT Pub. Date: Mar. 14, 1996

[30] Foreign Application Priority Data

Sep. 2, 1994 [GB] United Kingdom ..... 9417680

[51] Int. Cl.[6] ..... B22D 43/00

[52] U.S. Cl. ..... 266/45; 266/230; 222/594

[58] Field of Search ..... 266/227, 230, 266/45; 222/590, 594

[56] References Cited

U.S. PATENT DOCUMENTS

| | | | |
|---|---|---|---|
| 3,934,755 | 1/1976 | Rheinlander et al. | 266/230 |
| 4,494,734 | 1/1985 | LaBate et al. | 266/230 |
| 4,601,415 | 7/1986 | Koffron | 266/230 |
| 4,709,903 | 12/1987 | LaBate | 266/230 |
| 4,968,007 | 11/1990 | Forte et al. | 266/230 |
| 5,382,003 | 1/1995 | Sankaranarayanan et al. | 266/230 |
| 5,382,004 | 1/1995 | Connors, Sr. et al. | 266/230 |

FOREIGN PATENT DOCUMENTS

| | | |
|---|---|---|
| 1004078 | 9/1992 | Belgium . |
| 63-40668 | 2/1988 | Japan . |

*Primary Examiner*—Scott Kastler
*Attorney, Agent, or Firm*—Nixon & Vanderhye P.C.

[57] ABSTRACT

A flow control device for the outlet of a molten metal handling vessel is provided for use towards the end of the pouring of molten metal through the outlet. The flow control device has a head portion and a tail portion with flow channels defined between the head and tail portions to reduce vortex effects in the molten metal, the tail portion being contoured to fit into a correspondingly contoured entrance to the outlet with the flow channels leading into the outlet and the device being attached to a refractory positioning device so that it can be fitted into the outlet during flow of the molten metal through the outlet. The head includes a baffle plate covering the outlet.

20 Claims, 2 Drawing Sheets

FLOW CONTROL DEVICE

This invention relates to a flow control device for the outlet of a molten metal handling vessel, e.g. a ladle or a tundish. It is particularly concerned to provide a device which limits the formation of vortexing effects during the discharge of the molten metal, e.g. molten steel from a tundish.

For convenience the invention will be further described below with particular reference to the discharge of molten steel from a tundish although it will be appreciated that its application is not so limited.

As steel empties through the discharge outlet in a tundish a vortex effect can commonly occur around the outlet. This is undesirable as it can cause the entrainment of slag or other impurities into the steel passing from the tundish.

There has been a number of prior proposals to eliminate or reduce this unwanted vortex effect. For example, International Application PCT/CA 93/00529 describes a flow control device comprising a baffle plate and a plurality of dividers radially disposed to space the plate above an outlet nozzle of, e.g. a tundish. The radial dividers cause the steel to approach the nozzle outlet in several convergent radial streams whereby vortex entrainment can be eliminated.

JP-A-63 0668 teaches a flow control device to prevent vortex-formation in a tundish, which device has a head portion in the form of four vertical spaced blades of cruciform plan form and which is attached by a support rod to the lid of the tundish.

One problem with most prior proposals to reduce vortexing is that the proposed device has to be positioned in the, e.g. tundish prior to filling with molten steel and must then last for the life of the sequence of casting being employed. Even though it is possible to manufacture devices with such a life span, they are subject to considerable build up of oxides created by the complex flow with the result that the outlet flow area can be restricted, which can cause unwanted problems with the casting.

The present invention aims to provide a flow control device that overcomes these deficiencies of the prior art.

Accordingly, in one aspect the invention provides a flow control device for the outlet of a molten metal handling vessel, the device having a head portion and a tail portion and flow channels defined between the head and tail portions, the tail portion being contoured to fit into a correspondingly contoured entrance to the outlet with the flow channels leading into the outlet, the device being attached to a refractory positioning means whereby it can be fitted into the outlet during flow of the molten metal through the outlet, wherein the head portion comprises a baffle plate to cover the outlet to reduce vortex effects in the molten metal.

In another aspect the invention provides a method of controlling the flow of molten metal through an outlet from a vessel in which a flow control device having a head portion and a tail portion is positioned so that its tail portion fits into a correspondingly contoured entrance to the outlet whereby flow channels defined between the head and tail portions lead into the outlet, characterised in that the head portion comprises a baffle plate which covers the outlet and the fitting is effected during the flow of the molten metal through the outlet by a refractory positioning means attached to the device.

The refractory positioning means may be, for example, a refractory arm or shaft, e.g. a tube, which may be disposable, attached at one end to the flow control device, usually to its head and of sufficient length to be manoeuvred from above the surface of the molten metal, preferably from outside the vessel. The shaft may, if desired, be integrally formed with the head of the device.

Most conveniently the flow control device is positioned in the outlet towards the end of the pouring of the metal through the outlet, whereby the aforesaid disadvantages of oxide build up may be avoided. Thus it may be inserted towards the end of the last "heat" being discharged in a sequence from a tundish.

The device may be manually positioned in the outlet using the positioning means or a mechanical setting may be employed, if desired.

The flow control device may be made from any refractory composition capable of withstanding the temperature and corrosive effects of the molten metal for at least short periods. Thus it may be disposable at the end of the pouring sequence from the vessel, i.e. dispensed with after a single use. Alternatively, if desired, it may be a recyclable unit manufactured, e.g. from isostatically pressed alumina graphite. A recyclable device should be removed from the vessel outlet immediately after the end of the pour, e.g. immediately after closure of a slide gate valve below the outlet.

The contoured entrance to the outlet may be a contoured well plate or inner nozzle block which may also be made of any suitable refractory material and, if necessary, may be rebuilt after closure of the outlet at the end of the sequence. The flow control device may be of any suitable design having a head and tail portion as previously described. One suitable type is as disclosed in the aforementioned PCT/CA 93/00529. Thus, the head portion may comprise a baffle plate disposed in use above the nozzle outlet and the tail portion may comprise radial dividers disposed about the longitudinal axis of the outlet and supporting the baffle so as to space it from the outlet opening. Preferably, the dividers define radial flow paths having a combined cross-sectional area at least as great as the cross-sectional area for flow through the nozzle. The dividers obstruct rotational forces in the molten metal so that it flows radially and horizontally towards the nozzle outlet where the flow paths meet. The metal then passes axially through the outlet.

As indicated above, the invention is particularly useful in tundishes, particularly tundishes using slide gate control of the outlet. At the end of a casting sequence in conventional practice the quantity of steel left in the tundish after closure of the outlet is very variable as the main aim is to prevent slag passing through the outlet as this can cause severe quality problems.

Conventionally one of two operations is frequently used at the end of the casting sequence, e.g. using a 70,000 kg (70 ton) twin strand tundish, which would have an operating depth of about 1520 mm (60 inches).

a) The tundish would be drained until the scale weight on tundish weighing scales shows a certain value. For safety, this may yield a skull in the range 13,600–22,700 kg (30 to 50,000 lbs).

b) A slag-floating device may be inserted at ladle shut-off and this is monitored to 355 to 380 mm (14" or 15") height from the top of the tundish inner nozzle at which point the gate is shut. Typical skull weight is in the range of 6800 to 9100 kg (15 to 20,000 lbs).

The invention enables later shut off of the outlet to be employed. Yield improvement is improved even further when the tundish is equipped with a false bottom, thus increasing the height of the well area. In such instances skull weight may be reduced to about 1360 to 2270 kg (3,000 to 5,000 lbs) with no slag carry over.

The device may be used on its own or in conjunction with tundish weighing scales or a slag-floating device. With such combined use, success rates for the procedure can approach or even reach 100%.

Specific embodiments of the invention are now described by way of example only with reference to the accompanying drawings in which:

BRIEF DESCRIPTION OF THE DRAWINGS

In FIG. 1, a tundish 10 has a base 11, sidewalls 12 and a cover 13. An outlet 14 is provided through base 11 in a recessed region 11A defined by a higher false bottom region 11B of the base.

Figure 1:
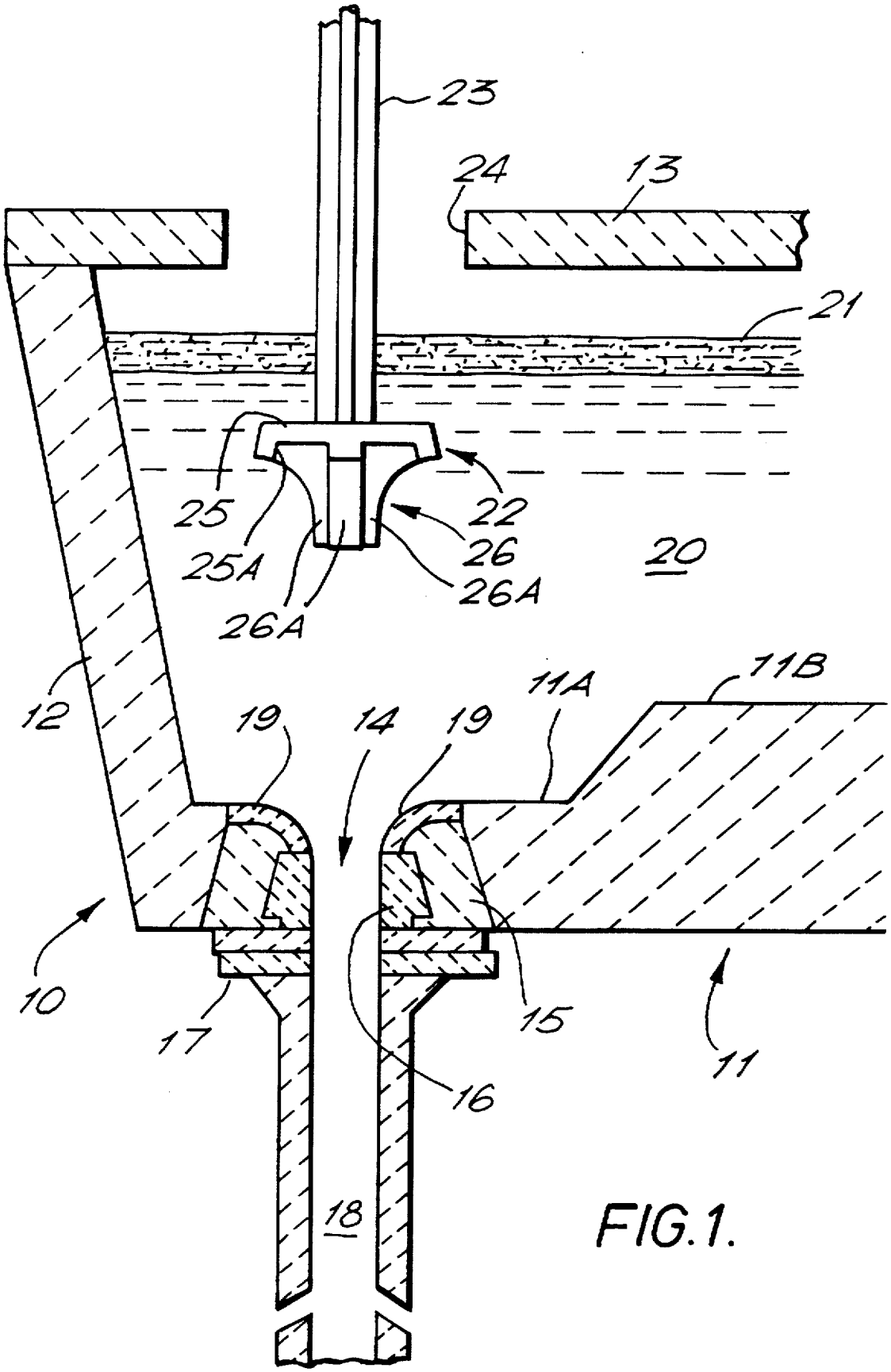
FIG. 1 is a diagrammatic representation of a section through a portion of a tundish in the region of its outlet at the beginning of pouring the last batch of steel of a sequence of pours.

Outlet 14 is defined by a conventional well nozzle 16 cooperating with a slide gate valve 17 to define an outlet passageway 18. A contoured well top plate 19 is fitted to overlie the tops of well block 15 and inner nozzle 16.

The tundish contains molten steel 20 covered by a slag layer 21. This steel is the last batch of a sequence of "heats" passed through the tundish.

The slide gate valve 17 is open and the steel is pouring out through passageway 18 in outlet 14.

As the pouring continues, a flow control device 22 of the invention is positioned above the outlet 14 on a disposable attachment arm 23 through an aperture 24 in cover 13. Device 22 has a head portion 25 with a lower surface 25A of castellated outline and a tail portion 26 comprising four fins 26A contoured to converge away from head 25.

Figure 2:
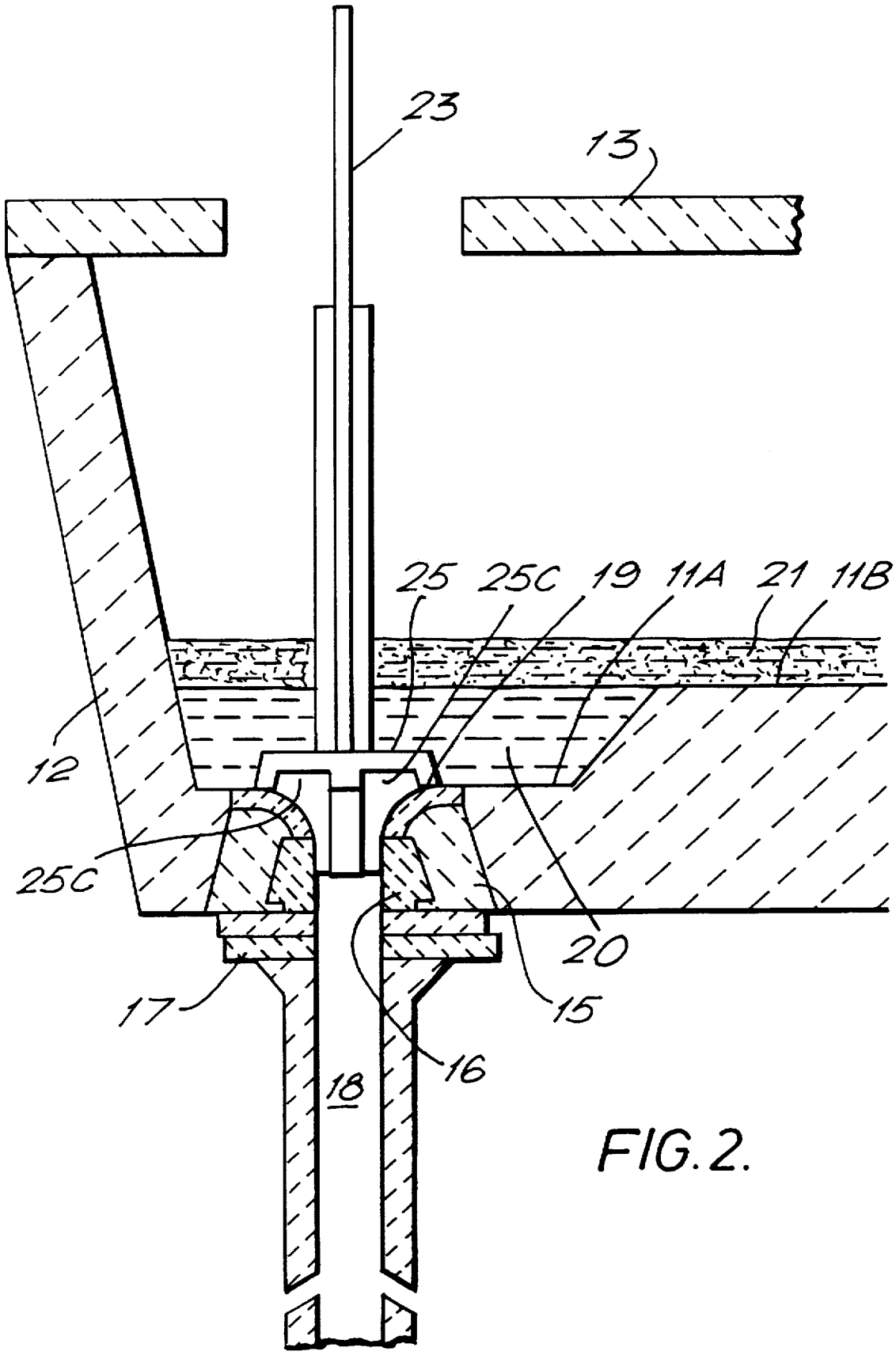
FIG. 2 is a similar view to FIG. 1 at the end of pouring of that batch.

The contouring of tail 26A corresponds to that of well top plate 19 into which the tail can be closely fitted—see FIG. 2.

In FIG. 2, the flow control device 22 has been fitted into the entrance to outlet 14 defined by the contoured well top plate 19. The castellations of surface 25A of the device 22 now define gaps 25C through which the steel can continue to flow through the outlet as the slide gate valve 17 is still open.

The slide gate valve 17 can be maintained open until the level of steel is very low because of the inhibition of vortex effects by device 22. Moreover, as can be seen in FIG. 2, the steel remains only in the recessed region 11A of the base of the tundish before the valve 17 has to be closed. Thus on closing valve 17 at the end of the casting sequence, the amount of wasted steel not poured from the tundish is significantly reduced.

I claim:

1. A flow control device for the outlet of a molten metal handling vessel said device having a head portion, a tail portion, and flow channels defined between said head and tail portions;

said tail portion being contoured to fit into a correspondingly contoured entrance to the outlet with said flow channels leading into the outlet device being attached to a refractory positioning device so that said flow positioning device can be fitted into the outlet during flow of the molten metal through the outlet and;

wherein said head portion comprises a baffle plate to cover the outlet, to reduce vortex effects in the molten metal.

2. A flow control device according to claim 1 wherein said refractory positioning device comprises a disposable shaft.

3. A flow control device according to claim 1 wherein said positioning device comprises a refractory tube of sufficient length to enable device to be manoeuvred into the outlet from outside the vessel.

4. A flow control device according to claim 1 wherein said device comprises a recyclable unit.

5. A flow control device according to claim 4 wherein said flow control device is made of isostatically pressed alumina graphite.

6. A flow control device according to claim 1 wherein said head portion has a lower surface of castellated outline, and said tail portion has fins contoured to converge away from said head.

7. A flow control device according to claim 1 wherein said tail portion comprises radial dividers disposed, in use, about the longitudinal axis of the outlet to support said baffle plate and space said baffle plate from the outlet opening.

8. A method of controlling the flow of molten metal through an outlet, which outlet has an entrance, from a vessel, using a flow control device having a head portion including a baffle plate, a tail portion, and flow channels between the head and tail portions, and using a refractory positioning device, said method comprising the steps of:

(a) allowing some molten metal to flow from the vessel through the outlet with the flow control device remote from the outlet; and (b) while the molten metal flows through the outlet, using the refractory positioning device moving the flow control device so that the tail portion thereof fits in the entrance to the outlet, so that the flow channels lead into the outlet, and so that the baffle plate covers the outlet, to reduce vortex effects in the molten metal.

9. A method as recited in claim 8 wherein step (a) is practiced to provide a sequence of molten metal discharges from the vessel, and wherein step (b) is practiced toward the end of the last of the molten metal discharges from the vessel.

10. A method as recited in claim 9 wherein step (b) is practiced by manually positioning the tail portion of the flow control device in the entrance to the outlet.

11. A method as recited in claim 8 comprising the further step of disposing of the flow control device after substantially all of the molten metal is discharged from the vessel.

12. A method as recited in claim 8 wherein the vessel is a tundish, and comprising the further step of using the tundish in conjunction with weighing scales, or a slag-floating device.

13. A method as recited in claim 9 wherein step (a) is practiced to keep the flow control device remote from the molten metal until just before use thereof.

14. A method as recited in claim 8 wherein the flow control device is recyclable; and comprising the further steps of (c) closing the outlet to terminate the flow of molten metal therethrough, and (d) substantially immediately after step (c), removing the recyclable flow control device from the vessel.

15. A method as recited in claim 8 wherein the vessel comprises a tundish having a recessed region adjacent the outlet, and the metal is molten steel; and comprising the further step of (c) closing the outlet to terminate the flow of molten steel therethrough; and wherein step (b) is practiced to move the flow control device into the recessed region of the tundish; and wherein step (c) is practiced when substantially the only remaining molten steel in the tundish is in the recessed region so that the amount of steel wasted, since it is not poured from the tundish, is significantly reduced compared to in a tundish without a recessed region and in which step (c) is practiced without concern for the amount of waste.

16. A flow control device according to claim 3 wherein said head portion has a lower surface of castellated outline, and said tail portion has fins contoured to converge away from said head.

17. A flow control device according to claim 3 wherein said tail portion comprises radial dividers disposed, in use, about the longitudinal axis of the outlet to support said baffle plate and space said baffle plate from the outlet opening.

18. A flow control device in a molten metal handling vessel, comprising in combination:

a molten metal handling vessel having a bottom and including an outlet in said bottom, with an entrance to said outlet, and a recessed region around said outlet;

a flow control device having a head portion including a baffle plate, a tail portion, and flow channels between said head and tail portions; and said flow control device positioned within said recessed region with said tail disposed in said entrance to said outlet, and said baffle plate above said outlet and covering said outlet, to reduce vortex effects in molten metal flowing through said outlet from said vessel.

19. A combination as recited in claim 18 wherein said vessel includes an open top portion; and further comprising a positioning device attached to said flow control device and extending outwardly from said recessed region to said open top portion of said vessel.

20. A combination as recited in claim 18 wherein said vessel comprises a tundish, which can contain molten steel; and wherein said flow control device is made of isostatically pressed alumina graphite.

* * * * *